US005707949A

United States Patent [19]

May et al.

[11] Patent Number: 5,707,949

[45] Date of Patent: Jan. 13, 1998

[54] PREVENTION OF DYE-BLEEDING AND TRANSFER DURING LAUNDERING

[75] Inventors: Donald Douglas May, Chadds Ford; Robert Craig Buck, West Grove, both of Pa.

[73] Assignee: E. I. du Pont de Nemours and Company, Wilmington, Del.

[21] Appl. No.: 627,516

[22] Filed: Apr. 4, 1996

[51] Int. Cl.[6] ..... C11D 3/37

[52] U.S. Cl. ..... 510/276; 510/475; 510/531

[58] Field of Search ..... 510/276, 278, 510/531, 475

[56] References Cited

U.S. PATENT DOCUMENTS

| | | | |
|---|---|---|---|
| 3,563,904 | 2/1971 | Schmadel et al. | 510/276 |
| 3,563,905 | 2/1971 | Schmadel et al. | 510/276 |
| 3,790,344 | 2/1974 | Frickenhaus et al. | 8/165 |
| 4,908,449 | 3/1990 | Moore et al. | 510/425 X |
| 5,073,442 | 12/1991 | Knowlton et al. | 428/267 |
| 5,525,125 | 6/1996 | Cole et al. | 8/555 |

FOREIGN PATENT DOCUMENTS

| | | |
|---|---|---|
| 2165803 | 12/1971 | Germany . |
| 4224762 | 2/1994 | Germany . |
| 51-105490 | 9/1976 | Japan . |
| 52-015689 | 2/1977 | Japan . |
| 52-025178 | 2/1977 | Japan . |

*Primary Examiner*—Michael Lusignan

[57] ABSTRACT

Adding to a laundry detergent a resole condensation polymer prepared by reacting bis(hydroxyphenyl)sulfone with formaldehyde in the presence of a base thereby preventing or suppressing dye-transfer and dye-bleeding during laundering of nylon, rayon, cotton, acetate, or wool fabrics is disclosed.

10 Claims, No Drawings

PREVENTION OF DYE-BLEEDING AND TRANSFER DURING LAUNDERING

FIELD OF THE INVENTION

The present invention relates to the prevention or suppression of the bleeding of dyes from fabrics into the wash water and the transfer of dyes between fabrics during laundering.

BACKGROUND OF THE INVENTION

Textile fabrics, such as nylon, rayon, acetate, cotton and wool, suffer from dye loss or bleeding when laundered at the high pH and temperatures characteristic of conventional laundering operations. Not only does this loss of dye degrade the esthetics of the fabrics being laundered, but once dye has bled into the wash water, transfer to other textiles can readily occur. While separation of differently colored fabric may minimize the problem, such separation in small washing loads is time-consuming and dye bleeding continues to occur. Moreover, frequently the trim of a garment is of a different color than that of a garment, or the garment has white trim and cannot conveniently be separated from the garment.

Various additives have been been proposed to deal with dye-bleeding and transfer problems. For example, synthetic polyamides have been dyed and then treated with sulfonate-containing condensation products of (a) 4,4'-dioxydiphenylsulfone, (b) formaldehyde, and (c) phenol sulfonic acid, naphthalene sulfonic acid, sodium sulfite or sodium hydrogen sulfite. Another example is the use of graying inhibitors of alkali metal or ammonium salts of sulfonated resins derived from the condensation of formaldehyde with phenol or naphthol, and/or alkylphenols. The condensation product of a lower aliphatic aldehyde and partially sulfonated 4,4'-dihydroxydiphenyl sulfone has been disclosed as a dye-fixing agent during the wet processing of polyamide-based synthetic fibers dyed with anionic or cationic dyes. The condensation product, either as the free sulfonic acid or as a metal salt to improve solubility in water, is used either by addition to the dye bath or in posttreatment of the dyeings. The compositions of the present invention do not contain sulfonic acid groups as free acid or as salts and show improved performance under laundering conditions as a result.

BRIEF SUMMARY OF THE INVENTION

The present invention comprises a composition which comprises (A) a laundry detergent and (B) a resole condensation polymer which had been prepared by reacting formaldehyde with bis(hydroxyphenyl)sulfone in the presence of a base comprising an inorganic compound having a pKa of 8.5 or higher, at a formaldehyde:bis(hydroxy-phenyl) sulfone molar ratio in the range between 0.6:1.0 and 4.0:1.0 and a base:bis(hydroxy-phenyl)sulfone molar ratio in the range between 0.1:1.0 and 3.5:1.0, the addition of said resole condensation polymer of to said laundry detergent providing prevention or suppression of dye-transfer and dye-bleeding during laundering of nylon, rayon, cotton, acetate, and wool fabrics, said composition being water-soluble or water-dispersible, and when dissolved or dispersed in water provides an aqueous solution or aqueous dispersion having a pH of 6.0 to 10.0.

The present invention further comprises an improved laundering process wherein the improvement comprises use of the above described composition of the present invention, or adding a resole condensation polymer as described above to a laundry detergent.

DETAILED DESCRIPTION OF THE INVENTION

The present invention comprises the addition of a resole condensation polymer to conventional laundry detergents, thereby providing prevention or suppression of dye-transfer and/or dye-bleeding during laundering of nylon, rayon, cotton, acetate, and wool fabrics. The resole condensation polymer is a base-catalyzed condensation product of a bis(hydroxyphenyl)sulfone with formaldehyde. The resole condensation polymers used in this invention contain neither carboxylic acid, sulfonic acid solubilizing groups, nor the salts of sulfonic acid groups. In particular, the compositions of this invention do not contain the sodium salts of sulfonic acid groups. As a result, the resole condensation polymer used in this invention shows improved performance under laundering conditions, and is used in admixture with laundry detergents. The resole condensation polymer dye-transfer and dye-bleed inhibiting agents of this invention are less sensitive to the high pH value of laundry detergents than previously known sulfonated phenol-formaldehyde resins. The resole condensation polymer dye-transfer and dye-bleed inhibiting agents of this invention are effective at a pH range of 6–10, a higher range than can be used with existing commercial dye-transfer inhibitors based on sulfonated phenol-formaldehyde condensates, and are thus much more effective in the presence of conventional laundry detergents with characteristic pH values as high as 10. The resole condensation polymers are added to laundry detergents at the point of use, or, more preferably, as a component of the laundry detergent during its manufacture.

The base-catalyzed reaction of a bis(hydroxyphenyl) sulfone (BHPS) with formaldehyde gives a product known as a resole which is water-soluble or water-dispersible. In a preferred embodiment, the BHPS-formaldehyde condensation products used in the present invention are those disclosed in U.S. Pat. No. 5,460,891, herein incorporated by reference. The BHPS used in this invention is 4,4'-sulfonyldiphenol or its isomers, such as 2,4'-sulfonyldiphenol, 2,2'-sulfonyldiphenol, or mixtures of the same. The base useful as the catalyst is any inorganic compound having a pKa of 8.5 or greater which, when dissolved in water, renders it basic and which does not add to formaldehyde. Ammonia should not be used. Examples of such suitable bases include alkali metal hydroxides, alkali metal carbonates, alkali metal bicarbonates, alkali metal borates, alkaline earth metal hydroxides, alkaline earth metal carbonates, alkaline earth metal borates or mixtures thereof. The preferred base is sodium or potassium hydroxide, most preferably sodium hydroxide.

In preparing the resole condensation polymer by the condensation of BHPS with formaldehyde, generally a basic aqueous medium, elevated temperature, and autogenous pressure are used. For safety, the reaction is conducted under an inert atmosphere. The molar ratio of formaldehyde to BHPS is from about 0.6:1.0 to about 4.0:1.0, preferably in the range between 0.6:1.0 and 1.1:1.0, and most preferably in the range between 0.7:1.0 and 0.9:1.0. The molar ratio of base to BHPS from about 0.1:1.0 to about 3.5:1.0, preferably in the range between 0.2:1.0 and 1.0:1.0. When the formaldehyde to BHPS molar ratio is in the range between 0.6:1.0 and 1.1:1.0, all of the base is added at the start of the reaction at a preferred molar ratio of base to BHPS of 0.2:1.0 to 0.8:1.0.

Reaction conditions vary. In order to complete the condensation reaction, a temperature of from about 100° to about 200° C., is typically employed. The reaction is conducted over a time period of from about one-quarter hour to about twenty four hours.

At formaldehyde to BHPS molar ratios in the range between 1.1:1.0 and 4.0:1.0, it is preferred that the base be added in two stages so as to prevent gelation. It is also preferred that in the range between 0.2 and 0.8 mole of base per mole of BHPS, the base is added at the start of the reaction and that the reaction be run at 80° to 100° C., preferably 100° C., for 4–12 hours, most preferably at 100° C. for 6 hours. After completion of the 4–12 hour reaction time period, additional base is added. The amount of additional base is in the range between 0.4 and 3.3 moles of base per mole of BHPS, preferably 1.0 mole of base per mole of BHPS. The reaction is then heated to a temperature in the range between 100° and 200° C., preferably in the range between 125° and 150° C., over a time period of one-quarter hour to 24 hours, preferably one-quarter to six hours. Reaction times at temperatures greater than 100° C. are monitored to prevent product gelation.

If the molar ratio of formaldehyde to BHPS is too high without sufficient base present, gelation will occur. If the molar ratio of formaldehyde to BHPS is too low, a significant amount of unreacted BHPS will remain in the product. At the end of the condensation reaction, whether one or two stages, the product is cooled to room temperature, and, if necessary, dissolved in sufficient aqueous base to give a translucent brownish solution. Bases suitable for dissolving the resole condensation polymers of this invention are the same as those used in the condensation reaction.

The resole condensation polymers are used in combination with dry or powder laundry detergents as well as liquid detergents conventionally used for laundering nylon, rayon, acetate, wool, and cotton fabrics. Examples of suitable detergents are "TIDE" (Procter and Gamble Corp., Cincinnati, Ohio) a commercial detergent containing anionic surfactants, enzymes, complex sodium phosphates, sodium carbonate, sodium sulfate, sodium silicates, fabric whitener, perfume/masking fragrance, and an agent to prevent deposits, and liquid laundry detergents, such as "WOOLITE" (Boyle-Midway, Inc.), a commercial detergent containing 21 to 30 weight percent of sodium lauryl sulfate and 25 to 30 weight percent of sodium dodecylbenzene sulfate.

In accordance with this invention, laundry detergents are modified to provide dye-transfer inhibition and dye-bleed inhibition by blending of the detergent with from about 20 to about 250 percent of BHPS-formaldehyde resole condensation polymer, based on the weight of laundry detergent. Preferably 100 to 150 percent of the resole condensation polymer is employed. Alternatively, the BHPS-formaldehyde resole condensation polymer and the detergent are added separately to the washing machine to give the same range of proportions. Laundry detergents in a typical application result in the laundering washwater having a pH of 6 to 10.

The BHPS resole condensates of this invention are suitable for use with fabrics made of nylon, rayon, cotton, acetate, polyester and wool. The BHPS resole condensates of this invention are added with the detergent in normal wash cycles, or preferably are added during the manufacture of the detergent.

The following examples are given in further illustration of the invention. The kinematic viscosity of the resole condensation polymer was determined at 10 weight % and pH 9 at 25° C. according to ASTM 446 using a Cannon-Fenske glass capillary.

EXAMPLE 1

Into a 100 ml 316 stainless steel shaker tube was charged 16.7 g (67 mmols), of 98% 4,4'-sulfonyldiphenol, 4.05 g (50 mmols) of 37% aqueous formaldehyde, and 1.78 g (13 mmols) of 30 weight % sodium hydroxide in 40 ml of deionized water. The air was replaced by nitrogen before closing the tube. The reactants were then heated to 150° C. with shaking and held for 24 hours at this temperature under autogenous pressure. The tube was then cooled to room temperature and discharged after release of pressure. The grayish solid dispersed product was dissolved with 10 weight % sodium hydroxide to a tannish solution containing 13 weight % of BHPS resole condensate. The kinematic viscosity of a 10 weight % solution adjusted to a pH value of 9.0 measured at 25° C. was 1.38 centistokes.

EXAMPLES 2–8

The resole condensation polymers of Examples 2 through 8 and Controls A–C were prepared in a manner similar to Example 1 as described in Table 1.

TABLE 1

| | Mols per Mol BHPS | | | Temp. | Viscosity |
|---|---|---|---|---|---|
| Example | Formaldehyde | NaOH | Hours | °C. | Centistokes |
| 1 | 0.75 | 0.2 | 24 | 150 | 1.38 |
| 2 | 0.75 | 0.6 | 24 | 150 | 1.42 |
| 3 | 0.75 | 0.8 | 24 | 150 | NM[1] |
| 4 | 0.9 | 0.4 | 24 | 150 | 1.59 |
| 5 | 1.0 | 0.4 | 24 | 150 | 2.01 |
| 6 | 1.1 | 0.4 | 24 | 150 | 59.85 |
| 7 | 0.75 | 0.4 | 12 | 160 | 1.47 |
| 8 | 0.75 | 0.4 | 6 | 170 | 1.42 |
| Control A | 0.75 | 0.0 | 24 | 150 | NM[1] |
| Control B | 0.5 | 0.4 | 24 | 150 | 1.05 |
| Control C | 1.2 | 0.4 | 24 | 150 | gelled |

[1]Not measured

EXAMPLE 9

Into a 400 ml stainless steel shaker tube was charged 83.4 g (0.33 mol) of a BHPS consisting of 90 weight % 4,4'-sulfonyldiphenol and approximately 10 weight % 2,4'-sulfonyldiphenol, 20.25 g (0.25 mol) of 37 weight % aqueous formaldehyde, and 18.0 g (0.13 mol) of 30 weight % sodium hydroxide in 200 ml deionized water. After replacing the air with nitrogen the tube was closed and heated with shaking for 24 hours at 150° C. The tube was then cooled to room temperature and discharged after release of pressure to give a grayish solid after filtration. This product was dissolved with 10 weight % sodium hydroxide to a tannish solution containing 19.8 weight % of BHPS resole condensate. The kinematic viscosity of a 10 weight % solution adjusted to a pH value of 9.0 measured at 25° C. was 1.66 centistokes.

EXAMPLE 10

Into a reaction flask equipped with a condenser, mechanical agitator and thermometer was charged 33.3 g (133 mmols) of 98 weight % 4,4'-sulfonyl-diphenol, 7.57 g (93 mmols) of 37 weight % aqueous formaldehyde, 7.2 g (54 mmols) of 30 weight % sodium hydroxide and 80 g of deionized water. The reactants were refluxed at 100° C. under agitation and nitrogen for 24 hours. The resole condensate product was then cooled to room temperature, and enough 10 weight % sodium hydroxide was added to give a clear, tannish colored solution. The kinematic viscosity of a 10 weight % solution adjusted to a pH value of 9.0 and measured at 25° C. was 1.45 centistokes.

EXAMPLES 11–14

The resole condensation polymers of Examples 11 through 14 and Controls D and E were prepared in a manner similar to Example 10 as described in Table 2.

TABLE 2

| | Mols per Mol BHPS | | | Temp. | Viscosity |
|---|---|---|---|---|---|
| Example | Formaldehyde | NaOH | Hours | °C. | Centistokes |
| 9 | 0.76 | 0.4 | 24 | 150 | 1.66 |
| 10 | 0.7 | 0.4 | 24 | 100 | 1.45 |
| 11 | 0.75 | 0.4 | 24 | 100 | 1.51 |
| 12 | 0.9 | 0.4 | 24 | 100 | 1.60 |
| 13 | 1.0 | 0.4 | 24 | 100 | 2.26 |
| 14 | 1.1 | 0.4 | 24 | 100 | 5.74 |
| Control D | 0.5 | 0.4 | 24 | 100 | 0.96 |
| Control E | 1.2 | 0.4 | 24 | 100 | gelled |

EXAMPLE 15

Into a one-gallon stirred autoclave was charged 202.5 g (2.5 mols), of 37 weight % aqueous formaldehyde, 834.0 g (3.34 mols) of BHPS consisting of 95 weight % 4,4'-sulfonyldiphenol and 5 weight % 2,4'-sulfonyldiphenol, 180 g (1.35 mols) of 30 weight % sodium hydroxide and 2000 g of water. The autoclave was sealed, swept with nitrogen and heated for 24 hours at 150° C. The reaction mixture was allowed to cool to about 70° C. before the addition of 300 g of 30 weight % sodium hydroxide. After stirring for 90 minutes, the reaction product was discharged as a translucent, homogeneous, amber colored liquid containing approximately 24.7 weight of BHPS condensates. The kinematic viscosity of a 10 weight % solution adjusted to a pH value of 9.0 measured at 25° C. was 1.52 centistokes.

EXAMPLE 16

Into a reaction flask fitted with condenser, magnetic stirrer and thermocouple was charged 30 g (120 mmol) of 99.5 weight % 4,4'-sulfonyl-diphenol, 15 g (185 mmol) of 37 weight % aqueous formaldehyde, 4 g (50 mmol) of 50 weight sodium hydroxide 2 g (10 mmol) sodium tetraborate hydrate and 155 g of deionized water. The contents were refluxed at 100° C. under agitation for 4 hours. Upon completion of reflux, the clear solution was heated to 125° C. for 4 hours in a stainless steel autoclave to give a yellow-brown viscous liquid.

EXAMPLE 17

Into a reaction flask fitted with condenser, magnetic stirrer and thermocouple was charged 20 g (80 mmol) of 99.5 weight % 4,4'-sulfonyl-diphenol, 10.5 g (130 mmol) of 37 weight % aqueous formaldehyde, 2.5 g (30 mmol) of 50 weight % sodium hydroxide and 65 g of deionized water. The contents were refluxed at 100° C. under agitation for 6 hours and an additional 5 g (60 mmol) of 50 weight percent sodium hydroxide was added. The resulting mixture was heated for 16 additional hours at 100° C.

EXAMPLE 18

Into a reaction flask fitted with condenser, magnetic stirrer and thermocouple was charged 20 g (80 mmol) of 99.5 eight % 4,4'-sulfonyl-diphenol, 12 g (148 mmol) of 37 weight % aqueous formaldehyde, 2.5 g (30 mmol) of 50 weight % sodium hydroxide and 65 g of deionized water. The contents were refluxed at 100° C. under agitation for 6 hours and an additional 10 g (120 mmol) of 50 weight percent sodium hydroxide was added. The resulting mixture was heated for 16 additional hours at 100° C.

EXAMPLE 19

Into a reaction flask fitted with condenser, magnetic stirrer and thermocouple was charged 20 g (80 mmol) of 99.5 weight % 4,4'-sulfonyl-diphenol, 6 g (74 mmol) of 37 weight % aqueous formaldehyde, 2.7 g (32 mmol) of sodium bicarbonate and 70 g of deionized water. The contents were then refluxed at 100° C. under agitation for 24 hours.

EXAMPLE 20

Into a reaction flask fitted with condenser, magnetic stirrer and thermocouple was charged 20 g (80 mmol) of 99.5 weight % 4,4'-sulfonyl-diphenol, 6 g (74 mmol) of 37 weight % aqueous formaldehyde, 11 g (40 mmol) of 50 percent aqueous sodium carbonate and 60 g of deionized water. The contents were then refluxed at 100° C. under agitation for 24 hours.

EXAMPLE 21

A 0.5 gram quantity of "TIDE" detergent was dissolved in 1000 ml water at a pH of about 10 to create a detergent solution. To a 50 ml aliquot of the detergent solution were added 1.5 grams "ZELAN" 8236 (a commercial BHPS/formaldehyde resole condensation polymer prepared with an alkaline catalyst, 25% active ingredient available from E. I. du Pont de Nemours and Co., Wilmington, Del.). Sample pieces of fabric comprising a blend of "SUPPLEX" microdenier nylon fibers and "LYCRA" spandex fibers dyed lobster red color, each piece being about 1 inch (2.54 cm) by 1 inch (2.54 cm) square, were placed in the solution. Corresponding pieces of "SUPPLEX/LYCRA" fabric samples were placed in a control solution containing only 50 ml of the water solution of said "TIDE" detergent. Both solutions were heated to 120° F. (49° C.) and held at that temperature for ten minutes. The control solution (containing no "ZELAN" 8236) turned pink due to substantial dye loss from the fabric into solution. The test solution containing "ZELAN" 8236 showed no change in color, indicating no dye loss.

EXAMPLE 22

A 0.7 g quantity of "WOOLITE" was dissolved in 1000 ml water (pH 6.7) to create a detergent solution. To a 50 ml aliquot of the detergent solution were added 1.5 grams "ZELAN" 8236 available from E. I. du Pont de Nemours and Co. Wilmington, Del. Sample pieces of dark red rayon velour fabric and 100% cotton white fabric, each piece being about 1 inch (2.54 cm) by 1 inch (2.54 cm) square, were placed in the detergent/"ZELAN" 8236 solution. Corresponding pieces of rayon and cotton fabrics were placed at room temperature (about 20° C.) in a 50 ml aqueous control solution containing the "WOOLITE" detergent but no "ZELAN" 8236. After 30 minutes, the fabric samples were removed. Both solutions became pinker indicating that dye bleed had occurred from the rayon fabric into the aqueous solution. The cotton fabric in the solution containing "ZELAN" 8236 remained white, but became pink in the control solution which contained no "ZELAN" 8236.

We claim:

1. A composition which comprises (A) a laundry detergent and (B) a resole condensation polymer which had been prepared by reacting formaldehyde with bis(hydroxyphenyl) sulfone in the presence of a base comprising an inorganic compound having a pKa of 8.5 or higher, at a formaldehyde:bis(hydroxy-phenyl)sulfone molar ratio in the range between 0.6:1.0 and 4.0:1.0 and a base:bis(hydroxy-phenyl)sulfone molar ratio in the range between 0.1:1.0 and 3.5:1.0, the addition of said resole condensation polymer to said laundry detergent providing prevention or suppression of dye-transfer and dye-bleeding during laundering of nylon, rayon, cotton, acetate, and wool fabrics, said composition being water-soluble or water-dispersible, and when dissolved or dispersed in water provides an aqueous solution or aqueous dispersion having a pH of 6.0 to 10.0.

2. The composition of claim 1 wherein said base is an alkali metal hydroxide, alkali metal carbonate, alkali metal bicarbonate, alkali metal borate, alkaline earth metal hydroxide, alkaline earth metal carbonate, alkaline earth metal borate or mixtures thereof.

3. The composition of claim 2 wherein said formaldehyde:bis(hydroxy-phenyl)sulfone molar ratio is in the range between 0.6:1.0 and 1.1:1.0, and wherein said base:bis(hydroxyphenyl)-sulfone molar ratio is in the range between 0.2:1.0 and 1.0:1.0.

4. The composition of claim 3, wherein said bis (hydroxyphenyl)sulfone consists essentially of 4,4'-sulfonyldiphenol.

5. The composition of claim 4 wherein said alkali metal hydroxide is sodium hydroxide.

6. In a process in which nylon, rayon, cotton, acetate, or wool fabrics are laundered at a pH of 6.0 to 10.0, the improvement comprising adding a water-soluble or water-dispersible resole condensation polymer to a laundry detergent, said resole condensation polymer having been prepared by reacting bis(hydroxyphenyl)sulfone with formaldehyde in the presence of a base comprising an inorganic compound having a pKa of 8.5 or higher, at a formaldehyde:bis(hydroxyphenyl)sulfone molar ratio in the range between 0.6:1.0 and 4.0:1.0 and a base:bis(hydroxy-phenyl)sulfone molar ratio in the range between 0.1:1.0 and 3.5:1.0, the addition of said resole condensation polymer to said laundry detergent preventing or suppressing dye-transfer and dye-bleeding during said laundering of nylon, rayon, cotton, acetate, polyester, or wool fabrics.

7. The process of claim 6 wherein said base is an alkali metal hydroxide, alkali metal carbonate, alkali metal bicarbonate, alkali metal borate, alkaline earth metal hydroxide, alkaline earth metal carbonate, alkaline earth metal borate or mixtures thereof.

8. The process of claim 7 wherein said formaldehyde:bis (hydroxyphenyl)sulfone molar ratio is in the range between 0.6:1.0 and 1.1:1.0, and wherein said base:bis (hydroxyphenyl)-sulfone molar ratio is in the range between 0.2:1.0 and 1.0:1.0.

9. The process of claim 8, wherein said bis(hydroxy-phenyl)sulfone consists essentially of 4,4'-sulfonyldiphenol.

10. The process of claim 9 wherein said base is sodium hydroxide.

* * * * *